US006569213B1

(12) United States Patent
Busch

(10) Patent No.: US 6,569,213 B1
(45) Date of Patent: May 27, 2003

(54) ORTHOPAEDIC PEDAL

(75) Inventor: Christer Busch, Uppsala (SE)

(73) Assignee: Stepit System AB, Saltsjöbaden (SE)

( * ) Notice: Subject to any disclaimer, the term of this patent is extended or adjusted under 35 U.S.C. 154(b) by 0 days.

(21) Appl. No.: 09/856,998

(22) PCT Filed: Nov. 11, 1999

(86) PCT No.: PCT/SE99/02048

§ 371 (c)(1),
(2), (4) Date: Aug. 31, 2001

(87) PCT Pub. No.: WO00/33918

PCT Pub. Date: Jun. 15, 2000

(30) Foreign Application Priority Data

Dec. 4, 1998 (SE) ..... 9804219

(51) Int. Cl.[7] ..... A63B 23/08; A63B 23/10
(52) U.S. Cl. ..... 48/79; 482/80; 482/146
(58) Field of Search ..... 482/146, 79–80

(56) References Cited

U.S. PATENT DOCUMENTS 2,374,730 A * 5/1945 Catlin ..... 272/57
3,525,522 A * 8/1970 Piller ..... 272/79
3,741,540 A * 6/1973 Shimizu ..... 272/83 R
4,422,635 A * 12/1983 Herod et al. ..... 272/96
5,035,421 A * 7/1991 Scheller ..... 272/96

FOREIGN PATENT DOCUMENTS

| | | | |
|---|---|---|---|
| DE | 27 44 996 | A1 * | 4/1979 |
| EP | 0294581 | A1 | 12/1988 |
| WO | 9218205 | A1 | 10/1992 |
| WO | 9703726 | A1 | 2/1997 |

* cited by examiner

*Primary Examiner*—Nicholas D. Lucchesi
*Assistant Examiner*—Lori Baker Amerson
(74) *Attorney, Agent, or Firm*—Renner, Otto, Boisselle & Sklar, LLP

(57) ABSTRACT

Device for stimulating venous return in the lower limbs including a frame (1) intended to rest with a supporting surface against a foundation such as a floor, a bed head, a wall etc. The device is distinguished in that a foot plate (4) is arranged to tilt on frame (1) from an starting position that is angled in relation to the floor and thus frame (1) around an axle (5), that foot plate (4) is provided with a leaf spring (9) acting between a section (7) of the frame and the underside of foot plate (4), that the section (7) has such a form that when foot plate (4) pivots from the said starting position, leaf spring (9), by being progressively tensioned by the interaction of the frame with the section of the spring, increases the resistance against the pivoting of foot plate.

11 Claims, 1 Drawing Sheet

ORTHOPAEDIC PEDAL

FIELD OF THE INVENTION

Figure 1:
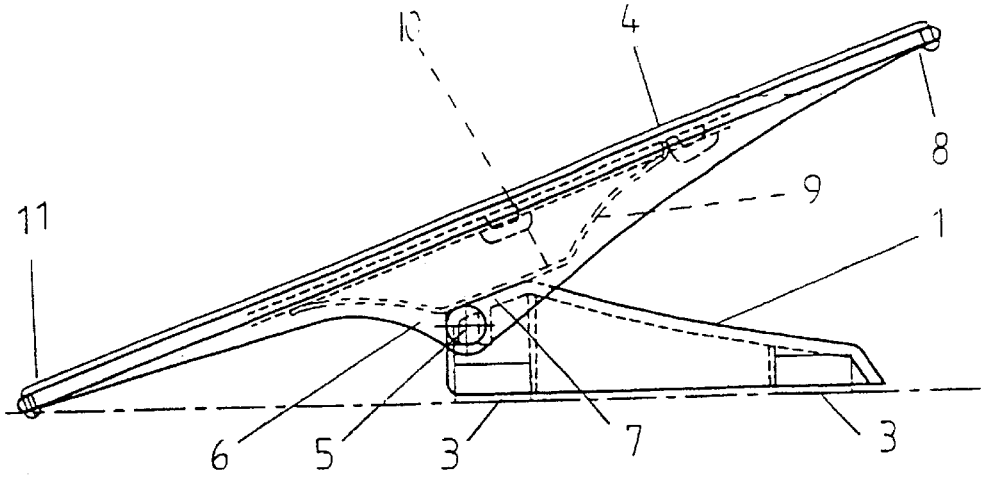

The present invention relates to a device for stimulating venous return in the lower limbs.

BACKGROUND OF THE INVENTION

It is well known that sitting for long periods of time leads to an impaired venous return in the lower limbs that is expressed, among other things, as local gatherings of blood. This causes discomfort in the form of, for example, swelling around the ankles and difficulties in putting on shoes. However, the effects of long term sitting can be much more serious, especially in the elderly. In certain cases, the sedentary state of the blood (stasis) can lead to the formation of blood clots that can follow along with the venous blood when the person concerned begins to move the legs and this can lead to pulmonary embolism, a life threatening condition. Examples of long term sitting that cannot be avoided are air travel, convalescence or invalidity that makes the person concerned temporarily or permanently confined to a wheelchair.

This blood stasis can be counteracted by moving the lower limbs at regular intervals as the muscles in the leg bring about a type of pumping effect when interacting with the venous valves that act as the one-way valves.

However, moving the legs in an appropriate manner without an aid while in a sitting position is tiring. To make the movement exercises more "natural" and thus easier and more comfortable to carry out, a number of devices intended for this task have been suggested, among others those specified in U.S. Pat. Nos. 4,669,744 and 5,035,421 as well as the published German document 27 44 996, WO 84/00695 and the Swedish patent 9502605-0. All of these devices aim to allow the foot to make more or less "natural" movement patterns of the type dorsal/plantar flexion, possibly in combination with inversion/eversion respectively pronation/supination of the foot.

These known devices are, however, marred by a series of disadvantages that are related to the design or the physiological movement. Only by means of a device that is easy to manufacture and transport, simple to use and that at the same time offers the possibility of exercise movements that are experienced as natural, will users be motivated to take the device with them on, for example, longer journeys, and to perform the exercise movements sufficiently often to achieve the intended effect of promoting circulation and hindering stasis.

OBJECTIVE OF THE INVENTION

One objective of the invention is to thus specify a device for stimulating venous return in the lower limbs that is improved in the ways referred to in relation to the prior art, especially a device that is adapted to allow a "natural" movement pattern with reference to the physiological movement of the leg/foot and to limit the movement to primarily just this pattern of movement. At the same time, it is possible with the aid of the invention to massage and stimulate the sole of the foot and similarly massage and activate the veins under the arch of the foot, the plantar indentation. It is also an objective of the invention to show design features for such a device that allow it to be executed in a way that is simple, functional and easy to transport.

SUMMARY OF THE INVENTION

In accordance with the present invention, a device for stimulating venous return in the lower limbs is specified that in a simple and controlled manner allows a leg/foot movement in three phases; a dorsal flexion phase, a rolling phase and a return phase. The combination of the dorsal flexion phase and the rolling phase results in a movement that is experienced as "natural" and that stimulates the venous return in an effective manner that is in accordance with the objective.

The device for stimulating venous return according to the invention is achieved by means of the characteristics specified in the claims.

Figure 2:
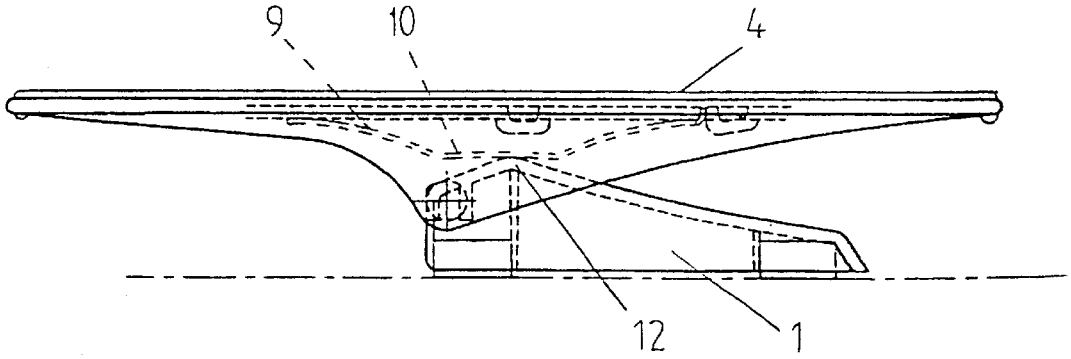
Figure 3:
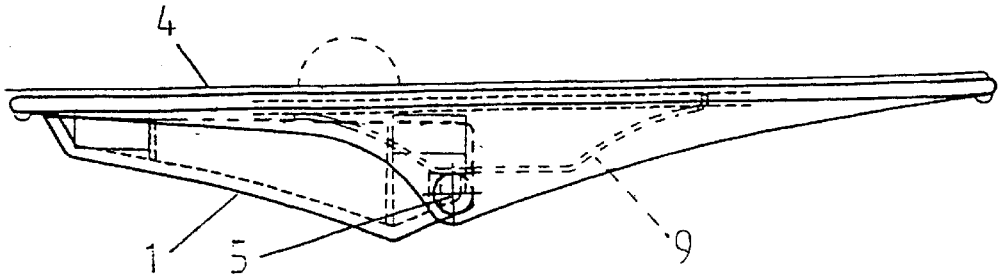

The invention will be described in more detail in the form of an example with reference to the drawings where FIG. 1 shows schematically a device according to the invention in its starting position, FIG. 2 shows the device with the foot plate tipped to a working horizontal position, and FIG. 3 shows the frame and foot plate folded together in the transport position.

The device for stimulating venous return according to the invention shown in FIG. 1 includes a frame 1 intended to rest with a supporting surface against a foundation such as a floor, a bed head, a wall or another foundation suitable for use. The frame can be provided with anti-sliding bodies, e.g. rubber pads, on its supporting surface, as indicated with 3 and/or be covered with Velcro material. Naturally, it is also possible to attach the frame to the foundation.

In addition, the device according to the invention has a foot plate 4 that on its upper side can, for example, can be covered with a material that counteracts the foot sliding on the foot plate 4. The device can naturally be used with the bare foot or with the foot in a sock or a shoe. It can be appropriate to provide the foot plate with a support that is, for example, similar to the heel support of a ski binding at its heel end. Even straps, loops or similar that help hold the foot against the foot support plate 4 can be arranged or the plate can be designed as a slipper or similar.

Foot plate 4 can be tilted by means of a rotating axle 5 mounted on frame 1 between two flanges 6 (only one of which is shown). Rotating axle 5 supports foot plate 4 at the flanges 6 to pivot at a certain distance from frame 1. Frame 1 has been designed with a section 7 that runs at a oblique angle from rotating axle 5 towards the toe part 8 of foot plate 4. On its underside, foot plate 4 is provided with an elongated leaf spring 9 that has a part 10 that runs essentially parallel with the direction of foot plate 4 between foot plate 4 and frame 1. Leaf spring 9 is attached to foot plate 4 at one of its ends while the other end rests so that it is able to slide against one part of the underside of foot plate 4.

The starting position, i.e. the position taken up by the device when it is placed on the foundation and ready for use, is evident from FIG. 1. In this situation, foot plate 4 takes up an angled position that is stable due to the flat part 10 of spring 9 resting in a tensioned manner against the angled part 7 of frame 1. When the foot plate is pivoted from this starting position by the foot to a position that is more parallel with the foundation (see FIG. 2) to perform a cycle of exercise, the flat part 10 of the spring will ascend the flat section 7 onto the brow 12 of frame 1 (see FIG. 2), which means that the spring is successively pressed inwards or tensioned from the position shown in FIG. 1 to that shown in FIG. 2. It should be realised that the foot plate can be pivoted by the working of the foot beyond the horizontal position shown so that the toe part 8 reaches the floor.

The user thus rests the foot against the foot plate 4, the dorsal flexion phase, with primarily an evenly divided pressure of contact. The user begins the movement by pressing down the toe part 8 of foot plate 4 with the forward part of the foot, whereby foot plate 4 pivots about axle 5 with increasing resistance. By letting the leg musculature relax, the pressure plate and therefore the foot in contact with it return to the starting position according to FIG. 1 with the help of the leaf spring 9. By repeating this movement, the blood stasis will be counteracted by the movement of the leg musculature that achieves a type of pumping effect when interacting with the venous valves that act as the one-way valves.

By turning the frame 1 clockwise from the position shown in FIG. 1, the frame will be folded up against the underside of the heel part 11 of foot plate 4 where the frame will be held in position with the help of the spring effect of the leaf spring 9. This is the transport and storage position of the device.

Foot plate 4 and frame 1 can be cast in a strong material, hardened plastic, light metal, etc., and the upper surface of the foot plate can be covered in a suitable comfortable material that prevents the foot from sliding off the plate. To massage and stimulate the sole of the foot of the user, the upper surface of the foot plate can be covered with a number of relatively closely located spikes or elevations that in a known way locally massage the sole of the foot. In a similar way, the upper surface of the foot plate can have a raised part in the form of a support for the arch of the foot—pelott—that stimulates the veins under the arch of the foot in the plantar indentation. When the foot with the help of the pedal according to the invention is bent forwards and back the plantar indentation will successively be compressed by "rolling" from the starting position and decompressed on return to the starting stating position. This device with the elevation in the form of a "bump" on the upper surface of the plate shown with a dashed line is shown in FIG. 3. Naturally, this bump can be combined with the spikes on the upper surface of the plate. The shape of the plate when seen from above can naturally vary and neither this nor the size of the foot plate has any influence of the actual concept of the invention.

What is claimed is:

1. A device for stimulating venous return in the lower limbs comprising:

a frame having a bottom surface for resting on a foundation;

an axle;

an elongated foot plate pivotally attached to the frame by the axle for tilting from an angled starting position, the axle being located under the foot plate, the axle extending at right angles to the longitudinal extent of the foot plate, and the axle being located at a middle area of the foot plate; and a leaf spring having ends thereof engaging an underside of the footplate, and the frame having a section thereof interacting with a section of the spring between the ends thereof.

2. The device according to claim 1, wherein the leaf spring interacts with the frame progressively to increase the resistance against pivoting of the foot plate as the foot plate moves from the starting position.

3. The device of claim 2, wherein the leaf spring runs essentially parallel with the longitudinal extent of the foot plate.

4. The device according to claim 3, wherein foot plate has a toe section, and the section of the frame that interacts with the spring has an essentially flat section that is angled from the axle towards the toe section of the foot plate and against which the leaf spring rests when the foot plate is in the angled starting position.

5. The device according to claim 4, wherein the frame portion is pivotable to a position whereat the support surface of the frame abuts an underside of the foot plate at a heel portion of the foot plate.

6. The device of claim 1, wherein the leaf spring runs essentially parallel with the longitudinal extent of the foot plate.

7. The device according to claim 6, wherein foot plate has a toe section, and the section of the frame that interacts with the spring has an essentially flat section that is angled from the axle towards the toe section of the foot plate and against which the leaf spring rests when the foot plate is in the angled starting position.

8. The device according to claim 7, wherein the frame portion is pivotable to a position whereat the support surface of the frame abuts an underside of the foot plate at a heel portion of the foot plate.

9. The device according to claim 1, wherein foot plate has a toe section, and the section of the frame that interacts with the spring has an essentially flat section that is angled from the axle towards the toe section of the foot plate and against which the leaf spring rests when the foot plate is in the angled starting position.

10. The device according to claim 9, wherein the frame portion is pivotable to a position whereat the support surface of the frame abuts an underside of the foot plate at a heel portion of the foot plate.

11. The device according to claim 1, wherein the frame portion is pivotable to a position whereat the support surface of the frame abuts an underside of the foot plate at a heel portion of the foot plate.

* * * * *